US011474461B2

(12) United States Patent
Mimbu et al.

(10) Patent No.: US 11,474,461 B2
(45) Date of Patent: Oct. 18, 2022

(54) FIXING DEVICE WITH NIP FORMING MEMBER HAVING GUIDE PORTIONS

(71) Applicant: RICOH COMPANY, LTD., Tokyo (JP)

(72) Inventors: Ryuuichi Mimbu, Kanagawa (JP); Toshihiko Shimokawa, Kanagawa (JP); Kazuya Saito, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/977,957

(22) PCT Filed: Mar. 7, 2019

(86) PCT No.: PCT/JP2019/009097
§ 371 (c)(1),
(2) Date: Sep. 3, 2020

(87) PCT Pub. No.: WO2019/188088
PCT Pub. Date: Oct. 3, 2019

(65) Prior Publication Data

US 2021/0041812 A1 Feb. 11, 2021

(30) Foreign Application Priority Data

Mar. 26, 2018 (JP) ..... JP2018-057542

(51) Int. Cl.
*G03G 15/20* (2006.01)
*D03D 13/00* (2006.01)
(Continued)

(52) U.S. Cl.
CPC ..... *G03G 15/2025* (2013.01); *D03D 13/002* (2013.01); *D03D 15/54* (2021.01);
(Continued)

(58) Field of Classification Search
CPC ..... G03G 15/2025; G03G 21/1685; G03G 2215/2093; G03G 2215/2096;
(Continued)

(56) References Cited

U.S. PATENT DOCUMENTS 8,615,175 B2 12/2013 Imada et al.
8,682,218 B2 3/2014 Yamaguchi et al.
(Continued)

FOREIGN PATENT DOCUMENTS

CN 107991848 A 5/2018
EP 3 115 398 A1 1/2017
(Continued)

OTHER PUBLICATIONS

International Search Report and Written Opinion dated May 17, 2019 in PCT/JP2019/009097 filed on Mar. 7, 2019.
(Continued)

*Primary Examiner* — Joseph S Wong
(74) *Attorney, Agent, or Firm* — Xsensus LLP

(57) ABSTRACT

A disclosed fixing device includes a pressing member; an endless tubular fixing member disposed opposite to the pressing member; a heating source configured to heat the fixing member; a nip forming member disposed opposite to the pressing member via the fixing member to form a nip portion; and a supply unit configured to supply lubricant to a portion of an inner surface of the fixing member, the portion facing the nip forming member, wherein the nip forming member includes a contact portion that contacts the inner surface of the fixing member, the contact portion includes a guide portion for guiding lubricant, and the guide portion is formed by extending obliquely from opposite ends in a width direction toward a center of the fixing member as the contact portion moves from upstream to downstream in a rotational direction of the fixing member.

8 Claims, 5 Drawing Sheets

(51) Int. Cl.
*D03D 15/54* (2021.01)
*G03G 21/16* (2006.01)

(52) U.S. Cl.
CPC . *G03G 21/1685* (2013.01); *G03G 2215/2035* (2013.01); *G03G 2215/2074* (2013.01); *G03G 2215/2093* (2013.01); *G03G 2215/2096* (2013.01)

(58) Field of Classification Search
CPC ... G03G 2215/2035; G03G 2215/2074; D03D 13/002; D03D 15/54
See application file for complete search history.

(56) References Cited

U.S. PATENT DOCUMENTS

| | | | | |
|---|---|---|---|---|
| 8,989,643 | B2 | 3/2015 | Gotoh et al. | |
| 2018/0203384 | A1* | 7/2018 | Okamoto | G03G 15/2053 |
| 2019/0010634 | A1* | 1/2019 | Aotani | B32B 27/20 |
| 2019/0163102 | A1* | 5/2019 | Yang | D03D 11/00 |

FOREIGN PATENT DOCUMENTS

| | | |
|---|---|---|
| JP | 2008-026603 | 2/2008 |
| JP | 2009-134074 | 6/2009 |
| JP | 5135994 | 2/2013 |
| JP | 5428402 | 2/2014 |
| JP | 2014-164245 | 9/2014 |
| JP | 2017-107121 | 6/2017 |
| JP | 2017-125961 | 7/2017 |

OTHER PUBLICATIONS

Chinese Office Action dated Jul. 1, 2022, in corresponding Chinese Application No. 201980020443.8.

* cited by examiner

[Fig. 1]
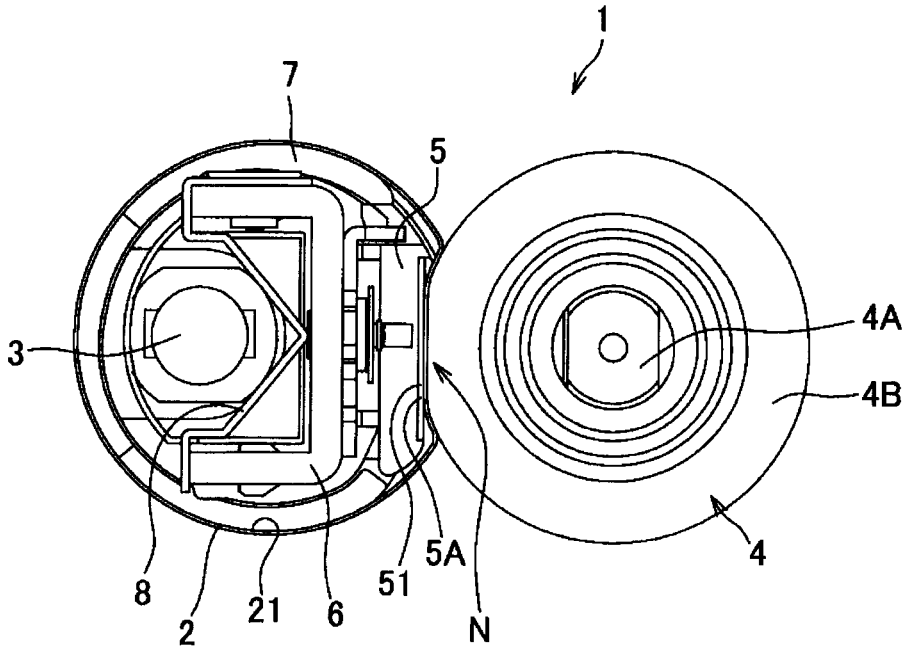

[Fig. 2]
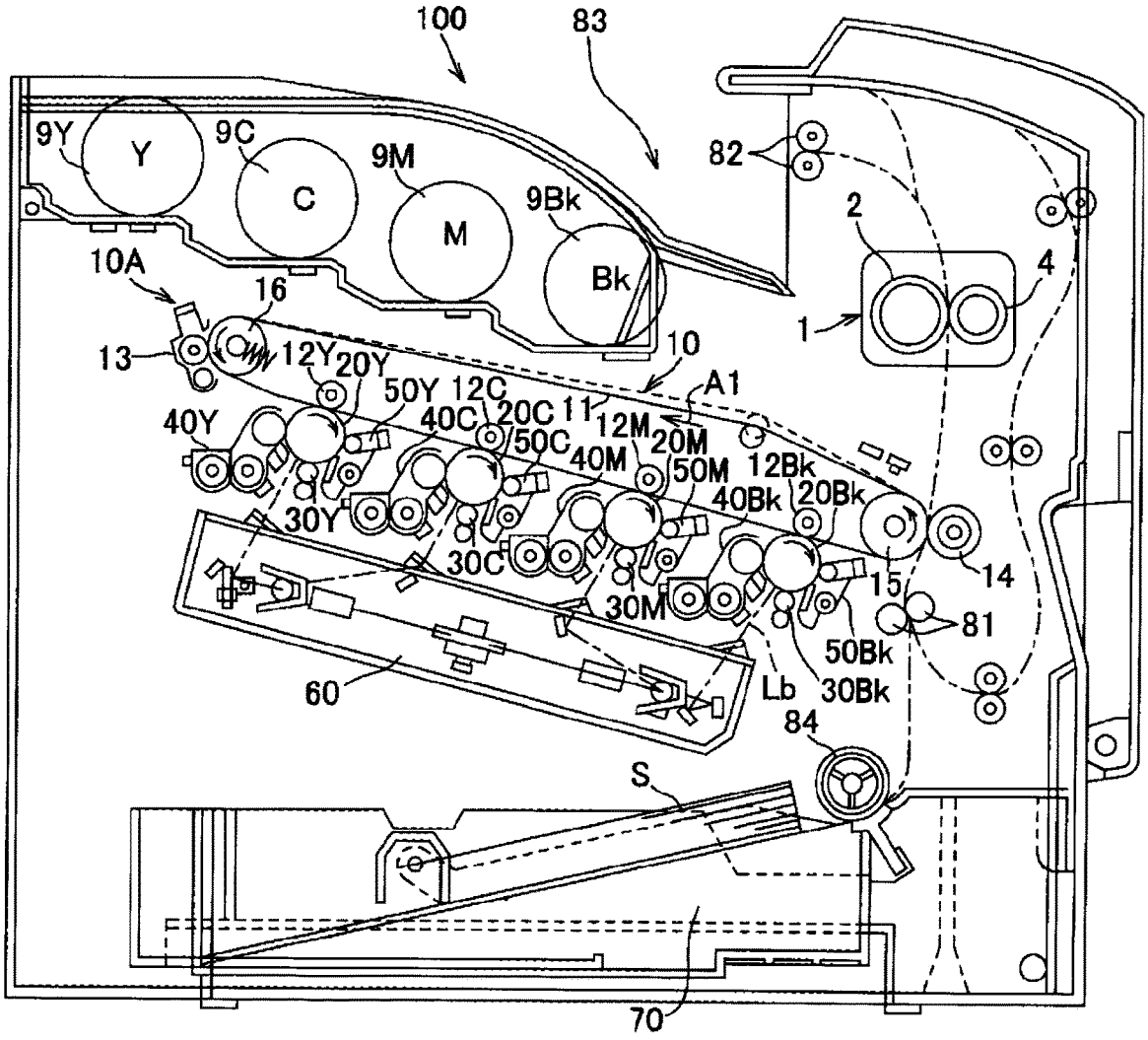

[Fig. 3]
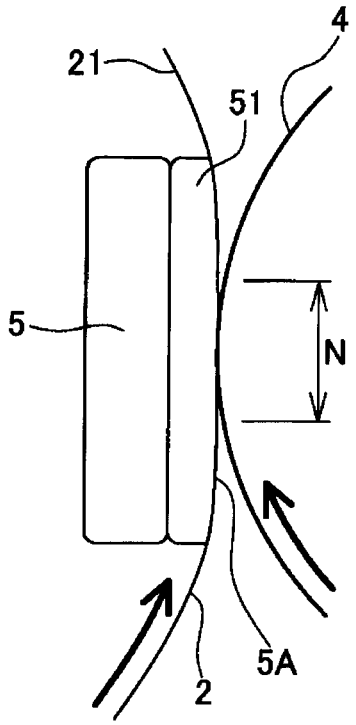

[Fig. 4]
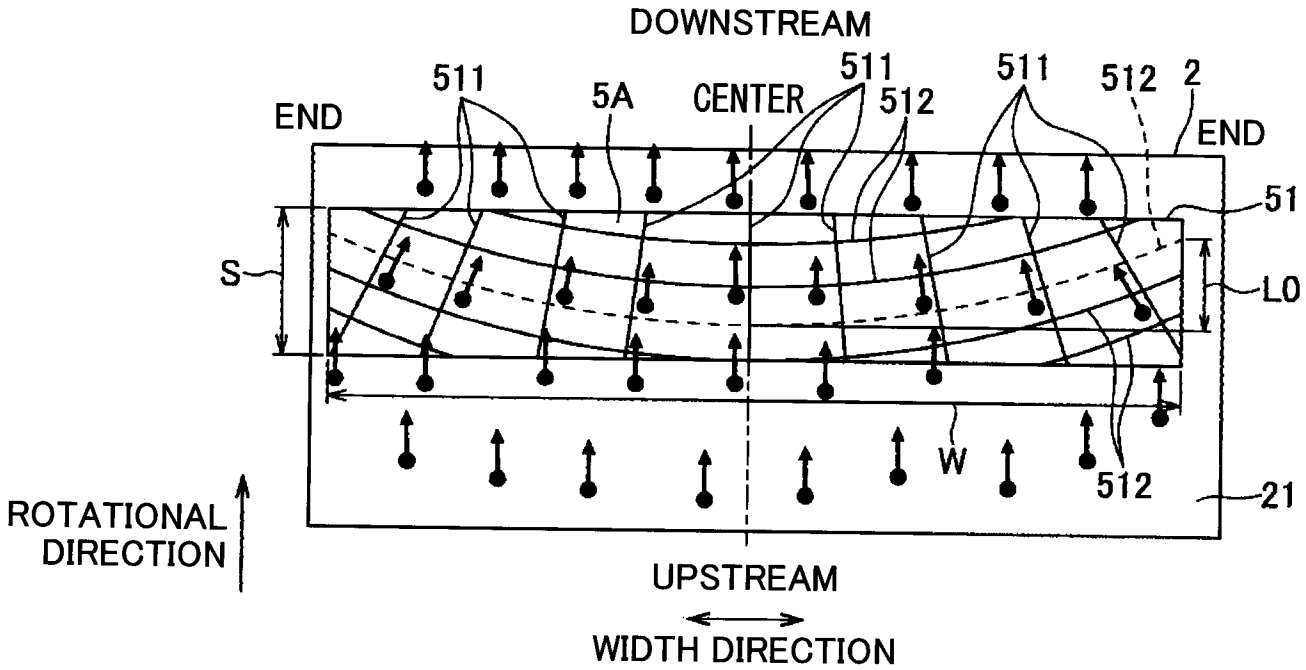

[Fig. 5]
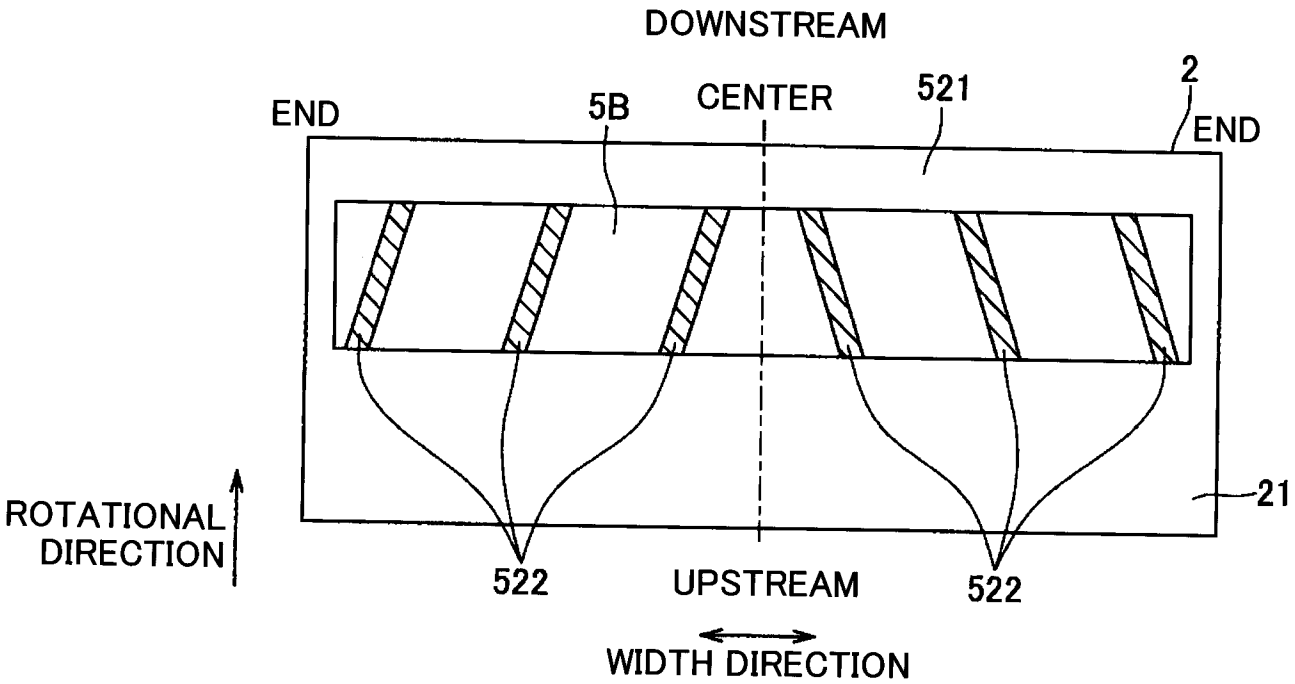

FIXING DEVICE WITH NIP FORMING MEMBER HAVING GUIDE PORTIONS

TECHNICAL FIELD

The disclosures herein relate to a fixing device and an image forming apparatus including the fixing device.

BACKGROUND ART

A fixing device having an endless cylindrical fixing member (fixing belt) and a pressing member is known to be a fixing device generally used in an image forming apparatus. Such a fixing device includes a nip portion that is formed by a fixing member and a pressing member. At the nip portion, toner is pressurized and heated so as to be fixed on a recording sheet.

Patent Reference 1 proposes an example of such a fixing device having a fixing belt, which is smoothly sliding on components inside the fixing device by applying a lubricant to an inner surface of the fixing belt. (e.g., Patent Reference 1). The fixing device described in Patent Document 1 is designed for preventing lubricant leakage from two ends of the fixing belt. The fixing device includes an absorbing member supporting member disposed inside of the fixing belt, grooves are formed on an outer peripheral surface of the fixing belt, and lubricant absorbing members are disposed in the grooves, thereby preventing lubricant leakage from the opposite ends of the fixing belt.

CITATION LIST

Patent Literature

[PTL 1] Japanese Unexamined Patent Publication No. 2008-26603

SUMMARY OF INVENTION

Technical Problem

However, in the fixing device described in Patent Document 1, although leakage of lubricant is prevented from flowing toward opposite ends of the fixing belt in a width direction, a total amount of lubricant applied to the fixing belt is decreased due to lubricant being absorbed by the lubricant absorbing members. As a result of lubricant absorption by the lubricant absorbing members, lubricant tends to be insufficient, particularly, in the center in the width direction of the fixing belt. The insufficient lubricant on the fixing belt increases sliding resistance between the fixing belt and components inside the fixing belt, thereby lowering slidability of the fixing belt on the components.

Thus, it is an object of the present invention to provide a fixing device and an image forming apparatus capable of maintaining sliding resistance low upon a fixing member rotationally sliding on the components.

Solution to Problem

According to at least one aspect of an embodiment, a fixing device includes a pressing member;

an endless tubular fixing member disposed opposite to the pressing member; a heating source configured to heat the fixing member; a nip forming member disposed opposite to the pressing member via the fixing member to form a nip portion; and a supply unit configured to supply lubricant to a portion of an inner surface of the fixing member, the portion facing the nip forming member, wherein the nip forming member includes a contact portion that contacts the inner surface of the fixing member, the contact portion includes a guide portion for guiding lubricant, and the guide portion is formed by extending obliquely from opposite ends in a width direction toward a center of the fixing member as the contact portion moves from upstream to downstream in a rotational direction of the fixing member.

Advantageous Effects of Invention

According to an aspect of the present invention, a fixing device includes a guide portion extending obliquely from opposite ends in a width direction toward a center of the fixing member as a contact portion of a nip forming member moves from upstream to downstream in a rotational direction of the fixing member. With a fixing device having this configuration, lubricant applied to an inner surface of the fixing member is guided toward the center in the width direction upon rotation of the fixing member. As a result, lubricant is prevented from flowing toward the opposite ends in the width direction of the fixing member, and leakage of lubricant is prevented. With this configuration, since lubricant does not need be absorbed by a lubricant absorbing member or the like, for preventing leakage of lubricant, a total amount of lubricant on the inner surface of the fixing member will not be lowered. Thus, the amount of lubricant on the inner surface of the fixing member will not be appreciably reduced, which therefore enables a low sliding resistance upon rotation of the fixing member to be maintained.

BRIEF DESCRIPTION OF DRAWINGS

FIG. 1 is a cross-sectional view illustrating a fixing device provided in an image forming apparatus according to an embodiment of the present invention;

FIG. 2 is a cross-sectional view schematically illustrating the image forming apparatus;

FIG. 3 is an enlarged sectional view illustrating a main part of the fixing device;

FIG. 4 is a plan view schematically illustrating flow of a lubricant in a fixing belt of the fixing device; and FIG. 5 is a plan view schematically illustrating a fixing belt of an image forming apparatus according to a modified example of the present invention.

DESCRIPTION OF EMBODIMENTS

In the following, embodiments of the present invention will be described with reference to the drawings. A fixing device 1 illustrated in FIG. 1 is disposed in an image forming apparatus 100 (see FIG. 2) according to a present embodiment. The fixing device 1 includes a fixing member 2, a heating source 3, a pressing member 4, and a nip forming member 5.

The fixing member 2 is a belt formed into an endless tubular shape, and may be formed into a film shape. The fixing member 2 is made of a metal such as nickel or SUS, or made of a resin material such as polyimide. The fixing member 2 includes a releasing layer such as a PFA or PTFE layer on its belt surface to have releasability so as not to adhere to toner. An elastic layer formed of a silicone rubber layer or the like may be provided between a base material of the belt (i.e., fixing member 2) and the releasing layer such as PFA or PTFE layer. In the absence of the silicone rubber layer, a heat capacity decreases and fixing capability improves; however, when an unfixed image is fixed by application of pressure, small unevenness on a surface of the belt is transferred to an image, and as a result, a glossy uneven rough texture (a rough texture image) is likely to remain at a solid portion of an image. In order to prevent this undesired rough texture, it is preferable to provide a silicone rubber layer of 100 μm or more. With such a silicone rubber layer being disposed between the belt and the releasing layer, small unevenness on the surface of the belt will be absorbed by deformed silicone rubber layer, and the rough texture image will not be formed.

A support member (stay) 6 for supporting a nip forming member 5 is disposed inside the fixing member 2, so as to prevent deflection of a nip forming member 5 that receives pressure applied by the pressing member 4, and to obtain a uniform nip width in an axial direction.

In the fixing device 1, a reflection member 8 is provided between the heating source 3 and the support member 6 so as to prevent wasteful energy consumption due to heating of the support member 6 with radiant heat from the heating source 3 or the like. Note that the same effect may be obtained by applying a heat insulation treatment or mirror surface treatment on the surface of the support member 6, instead of providing the reflection member 8.

The heating source 3 may be a halogen heater illustrated in the figure; however, the heating source 3 may be IH, a resistance heating element, a carbon heater, or the like. The fixing member 2 is directly heated from an inner periphery of the heating source 3. When the heating source 3 is a halogen heater, the fixing device 1 may have a light shielding plate. The light shielding plate is configured to block light applied by the halogen heater so as to apply heat to the fixing member 2 within a range according to size of a recording sheet. The light shielding plate has light passing portions to allow light to pass through corresponding to various sizes of recording sheets, and an appropriate one of light passing portions will be placed between the heating source 3 and the fixing member 2, for example by rotation of the light shielding plate.

The pressing member 4 includes an elastic rubber layer 4B on an outer side of a core metal 4A, and a not-illustrated releasing layer (PFA or PTFE layer) on the surface of the elastic rubber layer 4B for obtaining releasability. The pressing member 4 is rotated by driving force transmitted from a driving source such as a motor provided in the image forming apparatus 100 illustrated in FIG. 2 via gears. Further, the pressing member 4 is pressed against the fixing member 2 by a spring or the like, and upon application of pressure to the elastic rubber layer 4B, a predetermined nip width is formed by deformation of the elastic rubber layer 4B.

A pressure roller that is a hollow roller to have a heating source such as a halogen heater may be used. The elastic rubber layer may be a solid rubber; however, when there is no heater inside the pressure roller, a sponge rubber may be used. It is more preferable to use a sponge rubber because thermal insulation increases, and heat of a fixing sleeve is not appreciably lost.

The nip forming member 5 is disposed inside of the fixing member 2, that is, the nip forming member 5 is disposed on the opposite side of the pressing member 4, such that the nip forming member 5 is disposed on the opposite side of the pressing member 4 via the fixing member 2 to form a nip portion. More specifically, the nip forming member 5 is disposed on the opposite to the pressing member 4, with the fixing member 2 being interposed between the nip forming member 5 and the pressing member 4. Thus, the fixing member 2 and the pressing member 4 that face each other form a nip portion N. The recording sheet, to which a toner image has been transferred, passes through the nip portion N, where the toner image is heated and pressed to be fixed on the recording sheet.

The shape of the nip portion N is flat in FIG. 1; however, the shape of the nip portion N may be a concave shape or another shape. Note that with the concave shaped nip portion, a paper discharge direction of a leading edge of the recording sheet is directed toward the pressing member 4. This improves releasability of the recording sheet, and prevents paper jamming.

The nip forming member 5 (interrupt handling nip forming member) includes a low friction member 51 made of woven fabric and impregnated with a lubricant. The low friction member 51 is provided so as to come into contact with an inner surface 21 of the fixing member 2 (the low friction member 51 disposed on the nip forming member 5 side) to form a contact portion 5A. The low friction member 51 functions as a supply unit to supply a lubricant to an inner surface 21 of the fixing member 2. Note that examples of lubricant include silicone oil and grease. Details of the low friction member 51 will be described later.

The fixing member 2 is rotated with rotation of the pressing member 4. In the embodiment illustrated in FIG. 1, the pressing member 4 rotates by a driving source, and the fixing member 2 is rotated by transmission of driving force to the belt at the nip portion N. The fixing member 2 is rotated by being in contact with the pressing member 4 at the nip portion N, and the fixing member 2 at a position other than the nip portion N is rotated while being guided by holding members, which are inserted from both ends of the fixing member 2.

With the above-described configuration, it is possible to provide a fixing device that can warm up quickly and is inexpensive.

Next, the image forming apparatus 100 using the above configuration will be described with reference to FIG. 2.

The image forming apparatus 100 illustrated in FIG. 2 is a tandem system color printer, which includes image forming units for forming a plurality of color images arranged in parallel along a belt extending direction. The present invention may also be applied to other image forming apparatuses having systems other than the tandem system, and may also be applied to copying machines, facsimile machines, and the like.

The image forming apparatus 100 employs a tandem structure, where photosensitive drums 20Y, 20C, 20M and 20Bk are arranged in parallel. The photosensitive drums 20Y, 20C, 20M, and 20K act as image carriers capable of forming images corresponding to separate yellow, cyan, magenta, and black colors.

In the image forming apparatus 100 having the configuration illustrated in FIG. 2, a primary transfer process is performed to transfer visible images formed on the respective photosensitive drums 20Y, 20C, 20M and 20Bk onto an intermediate transfer member (hereinafter referred to as a transfer belt) 11 made of an endless belt, whereby respective color images are superimposed. The endless belt is capable of moving in a direction of an arrow A1 while facing the photosensitive drums 20Y, 20C, 20M. Subsequently, a secondary transfer process is performed to collectively transfer the superimposed images onto a recording sheet S such as a recording paper or the like.

The image forming apparatus 100 includes image forming units for forming an image according to rotation of the photosensitive drums 20Y, 20C, 20M and 20Bk. Such image forming units are disposed on the periphery of the photosensitive drums 20Y, 20C, 20M and 20Bk. The following description is given of an image forming unit for forming a black image as an example with reference to the photosensitive drum 20Bk. The photosensitive drum 20Bk is provided with a charging device 30Bk configured to form an image along a rotational direction of the photosensitive drum 20Bk, a developing device 40Bk, a primary transfer roller 12Bk, and a cleaning device 50Bk. An optical writing device 60 is used for writing after electrostatic image is formed.

When the transfer belt 11 moves in the A1 direction, visible images formed on the respective photosensitive drums 20Y, 20C, 20M and 20Bk are superimposed and transferred onto the same position on the surface of the transfer belt 11. That is, visible images are superimposed and transferred to the transfer belt 11 by voltage application from the primary transfer rollers 12Y, 12C, 12M and 12Bk disposed facing the photosensitive drums 20Y, 20C, 20M and 20Bk via the transfer belt 11, while shifting timing from upstream to downstream in an A1 direction.

The photosensitive drums 20Y, 20C, 20M and 20Bk are arranged in this order from the upstream in the A1 direction. The photosensitive drums 20Y, 20C, 20M and 20Bk are disposed in respective image stations for forming images of yellow, cyan, magenta and black.

The image forming apparatus 100 includes four image stations configured to form respective color images; a transfer belt unit 10 disposed above and facing the photosensitive drums 20Y, 20C, 20M and 20Bk, the transfer belt unit 10 including a transfer belt 11, and primary transfer rollers 12Y, 12C, 12M and 12Bk; a secondary transfer roller 14 disposed facing the transfer belt 11 and being configured to act as a transferring member to follow the transfer belt 11; a cleaning device 13 disposed facing the transfer belt 11 for cleaning the intermediate transfer belt 11; and an optical writing device 60 facing downward and disposed below the four image stations.

The optical writing device 60 includes a semiconductor laser as a light source, a coupling lens, an fθ lens, a toroidal lens, a folding mirror, and a rotating polygon mirror as deflection unit. The optical writing device 60 emits writing light Lb and the like with respect to respective colors of the photosensitive drums 20Y, 20C, 20M and 20Bk to form electrostatic latent images on the photosensitive drums 20Y, 20C, 20M and 20Bk. Note that in FIG. 2, only the image station for the black image is provided with a reference symbol, but the same applies to the other image stations.

The image forming apparatus 100 includes a sheet feeder 70 as a sheet feeding cassette for accumulating recording sheets S to be conveyed toward between the photo-sensitive drums 20Y, 20C, 20M and 20Bk and the transfer belt 11; a registration roller pair 81 configured to feed each recording sheet S conveyed from the sheet feeder 70 toward a transfer portion between the respective photosensitive drums 20Y, 20C, 20M and 20Bk and the transfer belt 11 at a predetermined timing according to a timing of forming the toner image by the image stations; and a not illustrated sensor configured to detect a leading edge of the recording sheet S upon reaching of the registration roller pair 81.

The image forming apparatus 100 includes a fixing device 1 as a roller fixing unit for fixing a toner image on a recording sheet S to which a toner image is transferred; a discharge roller 82 configured to discharge the recording sheet S to the outside of a main body of the image forming apparatus 100; a paper discharge tray 83 disposed at an upper part of the main body of the image forming apparatus 100, and being configured to accumulate the recording sheet S discharged by the discharge roller 82 from the main body of the image forming apparatus 100; and toner bottles 9Y, 9C, 9M and 9Bk disposed below the paper discharge tray 83, and being configured to be filled with yellow, cyan, magenta and black toners.

The transfer belt unit 10 includes a drive roller 15 and a driven roller 16 around which the transfer belt 11 is looped, in addition to the primary transfer rollers 12Y, 12C, 12M and 12Bk.

The driven roller 16 is provided with a force application unit using a spring or the like because the driven roller 16 also has a function as a tension application unit to apply tension to the transfer belt 11. Such a transfer belt unit 10, the primary transfer rollers 12Y, 12C, 12M and 12Bk, the secondary transfer roller 14, and the cleaning device 13 thus form a transfer device 10A.

The sheet feeder 70 is disposed at a lower part of the main body of the image forming apparatus 100, and has a feeding roller 84 that comes in contact with a top surface of the uppermost recording sheet S. By rotationally driving the feeding roller 84 in a counterclockwise direction, the uppermost recording sheet S is fed toward the registration roller pair 81.

The cleaning device 13 attached to the transfer device 10A has a cleaning brush and a cleaning blade that face the transfer belt 11 and come in contact with the transfer belt 11. The cleaning device 13 is configured to clean the transfer belt 11 by scraping off foreign substances such as residual toner on the transfer belt 11 using the cleaning brush and the cleaning blade.

The cleaning device 13 has a not illustrated toner discharging unit for carrying and discarding residual toner removed from the transfer belt 11.

The image forming apparatus 100 further includes an operation panel (not illustrated) for operating the entirety of apparatus, and a not illustrated controller configured to control the entirety of apparatus.

When the number of passed sheets, running time, rotational speed of the fixing member 2, or the like is equal to or more than a predetermined value, the controller causes the operation panel to display a maintenance request for the fixing member 2 (maintenance indication), and the operation panel functions as a display unit. That is, the controller displays necessity of maintenance on the operation panel at predetermined running intervals. Upon completion of maintenance, the controller stops maintenance indication and resumes the counting of the number of sheets passed, the running time, the rotation speed of the fixing member 2, and the like.

Next, details of the low friction member 51 of the nip forming member 5 in the fixing device 1 will be described with reference to FIGS. 3 and 4. FIG. 4 illustrates the inner surface 21 of the fixing member 2. Note that although the low friction member 51 is illustrated by being superimposed on the inner surface 21 in FIG. 4 for convenience of explanation, the actual low friction member 51 would not be viewable from outside. The low friction member 51 is made of woven fabric, which is a continuous sheet-shaped member. The low friction member 51 has a plurality of warps 511 and a plurality of wefts 512.

The plurality of warps 511 extend obliquely from opposite ends toward the center in a width direction of the fixing member 2, as the fixing member 2 rotates from upstream to downstream in a rotational direction, except for those arranged in the center in the width direction. The plurality of warps 511 function as guide portions for guiding lubricant. That is, lubricant applied to the inner surface 21 of the fixing member 2 moves along extending directions of the warps 511 while the fixing member 2 rotates and passes through the nip portion N.

The plurality of warps 511 are disposed along the width direction of the fixing member 2, and the warps 511 located closer toward the opposite ends in the width direction have a larger inclination angle θ with respect to a rotational direction of the fixing member 2. Where S represents a dimension of the low friction member 51 in the rotational direction, lubricant guided by the warps 511 moves toward the center in the width direction by Stanθ. Note that in a case where the fixing member 2 does not contact the low friction member 51 except for the nip portion N, or in a case where the pressing force is small upon the fixing member 2 coming into contact with the low friction member 51, lubricant guided by the warps 511 may move toward the center in the width direction by LNtanθ, where LN represents a nip width (a dimension of the nip portion N in the rotational direction).

The plurality of wefts 512 are curved upward toward the downstream in the rotational direction, and the vertex of the curve is positioned in the center in the width direction. The woven fabric forming the low friction member 51 has a plurality of wefts 512 that may include differing colors. In the illustrated example, four out of the five wefts 512 indicated by solid lines are black, and the remaining one indicated by a broken line is red. Note that the plurality of wefts 512 may be three or more colors.

Where L0 represents a dimension in the rotational direction (the amount of curvature from the center in the width direction toward opposite ends) of the weft 512, a preferable dimension L0 of the weft 512 in the rotational direction is 8 to 40% of the dimension S in a rotational direction of the low friction member 51. Further, where W represents the width of the low friction member 51, a preferable dimension L0 in the rotational direction of the weft 512 is 0.4 to 2% of the width W.

According to this embodiment as described above, the following effects will be provided. That is, the low friction member 51, which forms the contact portion 5A of the nip forming member 5, includes a plurality of warps 511 extending obliquely from the opposite ends toward the center in the width direction while the fixing member 2 rotates from the upstream to the downstream in the rotational direction. In the low friction member 51 provided with such warps 511, lubricant applied to the inner surface 21 of the fixing member 2 is guided toward the center in the width direction of the fixing member 2 upon rotation of the fixing member 2.

Accordingly, lubricant is prevented from flowing toward the opposite ends in the width direction of the fixing member 2, and leakage of lubricant is prevented. In this configuration, since lubricant need not to be absorbed by a lubricant absorbing member or the like, for preventing leakage of lubricant; a total amount of lubricant on the inner surface 21 of the fixing member 2 is not appreciably reduced. As a result, the amount of lubricant on the inner surface 21 of the fixing member 2 will not be appreciably reduced, which is enabled to maintain low sliding resistance upon rotation of the fixing member 2.

Further, the low friction member 51 may be arranged on the original position with some inclination due to a manufacturing error or the like in some cases. For example, the warps 511 arranged in the center in the width direction may be inclined with respect to the rotational direction. In such a case, although a position where lubricant gathers deviates from the center in the width direction in some extent, leakage of lubricant from the opposite ends of the fixing member 2 is prevented, and shortage of lubricant hardly occurs.

Since the plurality of warps 511 located closer toward the opposite ends in the width direction have a larger inclination angle θ, lubricant particularly at the opposite ends in the width direction will smoothly move toward the center. Thus, leakage of lubricant from the opposite ends of the fixing member 2 will further be prevented.

Further, since the wefts 512 of woven fabric, which forms the low friction member 51, is curved upward toward the downstream in the rotational direction, it is possible to measure the curvature of the warps 511 to manage the inclination angle θ of the warps 511.

Further, the woven fabric forming the low friction member 51 has a plurality of wefts 512 including differing colors. This facilitates recognition of shapes of the wefts 512, and measurement of the curvature of the wefts 512.

Since the fabric forming the low friction member 51 is a single continuous sheet member, leakage of lubricant from gaps between sheets will be prevented.

It should be noted that the present invention is not limited to the above-described embodiment, and includes other configurations and the like that can achieve the object of the present invention; and the following modifications and the like are also included in the present invention.

For example, in the above embodiment, the inclination angle θ is larger as the plurality of warps 511 are located closer toward the opposite ends in the width direction; however, the present invention is not limited to this example. The plurality of warps 511 may have the same inclination angle θ except for those located in the center, or the plurality of warps 511 located toward the opposite ends may have a smaller inclination angle θ. The inclination angle θ may be any degree, and may be appropriately set in accordance with inclination and the like of the low friction member 51 at the time of woven fabric manufacture.

In the above embodiment, woven fabric forming the low friction member 51 has a plurality of wefts 512 including differing colors; however, in a case where the curvature of the warps is easily measurable, the plurality of wefts 512 may each be of the same color. For example, depending on the thickness and gloss of the threads, the roughness of the weave, and the like, shapes of wefts of the same color may be easily recognized, and the curvature of wefts may be easily measured. Further, the plurality of wefts may be of the same color when the curvature of weft is easily managed or when an error of the curvature is small during manufacturing of fabrics.

In the above embodiment, the contact portion 5A of the nip forming member 5 is made of woven fabric and the warps 511 each function as a guide portion. However, the contact portion may be made of a material other than woven fabric.

For example, the contact portion may be made of a fluororesin or the like. A contact portion 5B illustrated in FIG. 5 is made of a fluororesin, and a plurality of recesses 522 are formed with respect to a contact surface 521 in contact with the inner surface 21 of the fixing member 2. The recesses 522 each extend obliquely from two ends in the width direction toward the center as the fixing member rotates from upstream to downstream in the rotational direction. The recesses 522 each function as a guide portion that guides lubricant. The contact portion 5B may be formed integrally with another portion of the nip forming member 5, or may be formed with a separate member.

As with the warps 511 in the above embodiment, the plurality of recesses 522 may have a larger inclination angle θ as being located closer toward the opposite ends in the width direction. In addition, the plurality of recesses 522 may have the same inclination angle θ, or the recesses 522 located closer toward the opposite ends may have a smaller inclination angle θ.

In the above embodiment, the low friction member 51, which is woven fabric forming the contact portion 5A, functions as a supply unit for supplying lubricant to the inner surface 21 of the fixing member 2. However, such a supply unit may be provided separately from a member forming the contact portion.

Although the best mode of configurations, methods, and the like for implementing the present invention are disclosed in the above description, the present invention is not limited thereto. While the invention has been particularly described with reference to particular embodiments thereof, it will be apparent to those skilled in the art that various modifications and alterations may be made by those skilled in the art without departing from the spirit and scope of the invention.

Therefore, the description that specifies shape, material and the like disclosed above is illustratively described in order to facilitate the understanding of the present invention, and does not limit the present invention. The description with names of members of which a part of or all of the restrictions such as shape, material and the like have been removed is included in the present invention.

REFERENCE SIGNS LIST

1 fixing device
2 fixing member
21 inner surface
3 heating source
4 pressing member
5 nip forming member
5A, 5B contact potion
51 low friction member (woven fabric, supply unit)
511 warp (guide portion)
512 weft
521 contact surface
522 recess
100 image forming apparatus The present application is based on and claims priority to Japanese Patent Application No. 2018-057542 filed on Mar. 26, 2018, the entire contents of which are hereby incorporated herein by reference.

The invention claimed is:

1. A fixing device, comprising:
a pressing structure;
an endless tubular fixing structure disposed opposite to the pressing structure;
a heating source configured to heat the fixing structure;
a nip forming structure disposed opposite to the pressing structure via the fixing structure to form a nip portion; and
a supplier configured to supply lubricant to a portion of an inner surface of the fixing structure, the portion facing the nip forming structure, wherein
the nip forming structure includes a contact portion that contacts the inner surface of the fixing structure, the contact portion includes a guide portion for guiding lubricant, and the guide portion is formed by extending obliquely from opposite ends in a width direction toward a center of the fixing structure as the contact portion moves from upstream to downstream in a rotational direction of the fixing structure,
the contact portion is made of woven fabric, and
the woven fabric includes a warp as the guide portion, and a weft that is curved upward toward the downstream,
the woven fabric includes a plurality of wefts, the plurality of wefts includes differing colors to facilitate recognition of shapes of the wefts and measurement of curvature of the wefts, and
an amount of curvature from the center in the width direction toward opposite ends of the weft is 8 to 40% of a dimension of the contact portion in the rotational direction.

2. The fixing device according to claim 1, wherein the contact portion includes a plurality of the guide portions arranged in the width direction, and the plurality of guide portions that are positioned closer toward the opposite ends in the width direction having a larger inclination angle with respect to the rotational direction.

3. The fixing device according to claim 1, wherein the woven fabric is one continuous sheet-like member.

4. An image forming apparatus comprising:
the fixing device according to claim 1.

5. The fixing device according to claim 1, wherein the plurality of wefts each includes mutually differing colors.

6. The fixing device according to claim 1, wherein the plurality of wefts includes three or more colors.

7. The fixing device according to claim 6, wherein the contact portion includes a plurality of recesses as a plurality of guide portions, and the plurality of recesses are each formed in a recess shape on a contact surface to be in contact with the inner surface.

8. An image forming apparatus comprising:
the fixing device according to claim 6.

* * * * *